US006474346B1

(12) United States Patent
Jang

(10) Patent No.: US 6,474,346 B1
(45) Date of Patent: Nov. 5, 2002

(54) POWDER CASE

(75) Inventor: Ki Hong Jang, Seoul (KR)

(73) Assignee: Sam Sung Corporation, Seoul (KR)

( * ) Notice: Subject to any disclaimer, the term of this patent is extended or adjusted under 35 U.S.C. 154(b) by 0 days.

(21) Appl. No.: 09/912,237

(22) Filed: Jul. 24, 2001

(30) Foreign Application Priority Data

May 4, 2001 (KR) ..... 01-13003

(51) Int. Cl.[7] ..... A45D 33/02; A45D 33/00; A45D 33/28

(52) U.S. Cl. ..... 132/307; 132/306; 132/293; 132/297

(58) Field of Search ..... 132/293, 297, 132/298, 299, 306, 307

(56) References Cited

U.S. PATENT DOCUMENTS 75,672 A * 3/1868 Ebaugh ..... 401/123
882,668 A * 3/1908 Davis ..... 132/293
1,206,439 A * 11/1916 Hoffman ..... 401/126
1,588,633 A * 6/1926 Taylor ..... 401/123
2,281,532 A * 4/1942 Lewis et al. ..... 401/123
2,689,966 A * 9/1954 Reuss ..... 401/126
4,446,879 A * 5/1984 Gueret ..... 132/293
4,626,119 A * 12/1986 Ladd ..... 401/123
4,832,060 A * 5/1989 Kingsford ..... 132/293
4,974,981 A * 12/1990 Bennett ..... 401/123
5,573,340 A * 11/1996 Gueret ..... 401/126

* cited by examiner

*Primary Examiner*—John J. Wilson
*Assistant Examiner*—Robyn Kieu Doan
(74) *Attorney, Agent, or Firm*—Levine & Mandelbaum

(57) ABSTRACT

A powder case comprises a lower case for receiving powder, with a first connector, and an upper case including a second connector to be coupled with the first connector, and a downwardly extending a cylindrical housing with a ledge for engaging a flange of a slider of a brush, and an array of apertures at its bottom. As the end of the brush is inserted into the housing the flange of the slider 23 engages the ledge so that the brush fur is exposed to the powder through the apertures. The connectors may include complementary threads or cleats which engage to secure to upper and lower cases.

4 Claims, 5 Drawing Sheets

POWDER CASE

BACKGROUND—FIELD Of INVENTION

The present utility relates to a powder case, more particularly, to a powder case that prevents dispersing of the powder when adhering the powder on a brush.

BACKGROUND—DESCRIPTION OF PRIOR ART

The conventional powder case, as described in FIG. 1, includes a case 1 which has an outer case 2. The outer case 2 has a receiving portion 3 and a tray 5. The receiving portion 3 receives the powder 4. And the tray 5 is for filling a part of the powder from the receiving portion 3, and is formed at an upper part of the receiving portion 3. The receiving portion 3 contains a puff 6 or a brush for adhering the powder. Also, a lid 7 is screwed to the case 1 in order to prevent separation of the puff 6 or the brush.

But, the conventional powder case is inconvenient to use. A user should to separate the tray 5 whenever taking out the powder from the receiving portion 3, fix the tray 5 into the receiving portion 3 again, and then here the powder on the puff 6 or the brush. Accordingly, whenever adhering the powder on the puff 6 or the brush, the powder 4 is dispersed around. Accordingly, there is a loss of the powder and the circumference is unclean.

SUMMARY OF THE INVENTION

In order to overcome the conventional problems, an object of the present utility is to provide a powder case that is easy to adhere the powder on a brush and prevents dispersing of the powder when adhering the powder on a brush.

In order to accomplish the object, the powder case comprises a lower case for receiving powder and being formed with a first conjunction around upper peripheral; and an upper case including a second conjunction to be coupled with the first conjunction on the inner peripheral surface of the lower case, a cylindrical housing formed vertically from the upper center to the lower, a ledge, formed along middle peripheral of the housing, for locking a flange of a brush, and an array of apertures at the bottom of the housing.

Consequently, the present utility has some advantages as follows.

If the end portion of the brush is inserted into the inner of the housing after leading out a slider of the brush, the slider is inserted into the case while the flange of the slider is locked on the ledge of the housing. Accordingly, the brush adheres the powder through the apertures. That is, a user may adhere the powder on the brush by only inserting the brush into the housing. The inserting work is very comfortable, and the loss of the powder is prevented, and a problem of the uncleanness of the circumference is solved.

BRIEF DESCRIPTION OF DRAWINGS

These and other features, and advantages of the present utility will become better understood with regard to the following description, appended claims, and accompanying drawings, in which like components are referred to by like reference numerals. In the drawings:

DETAILED DESCRIPTION OF PREFERRED EMBODIMENT

Hereinafter, preferred embodiment of the present utility will be described in detail with reference to the accompanying drawings.

Figure 1:
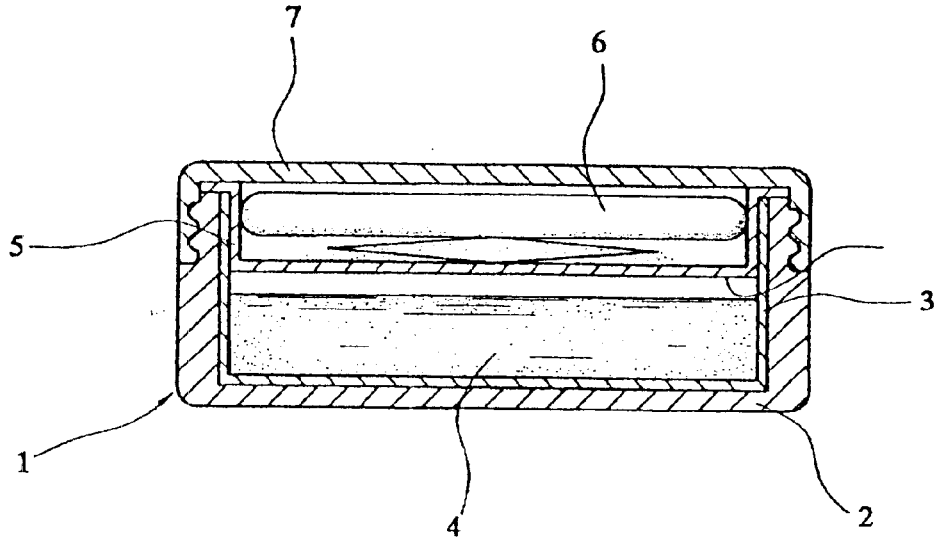
FIG. 1 is a plane of a conventional powder case.
Figure 2:
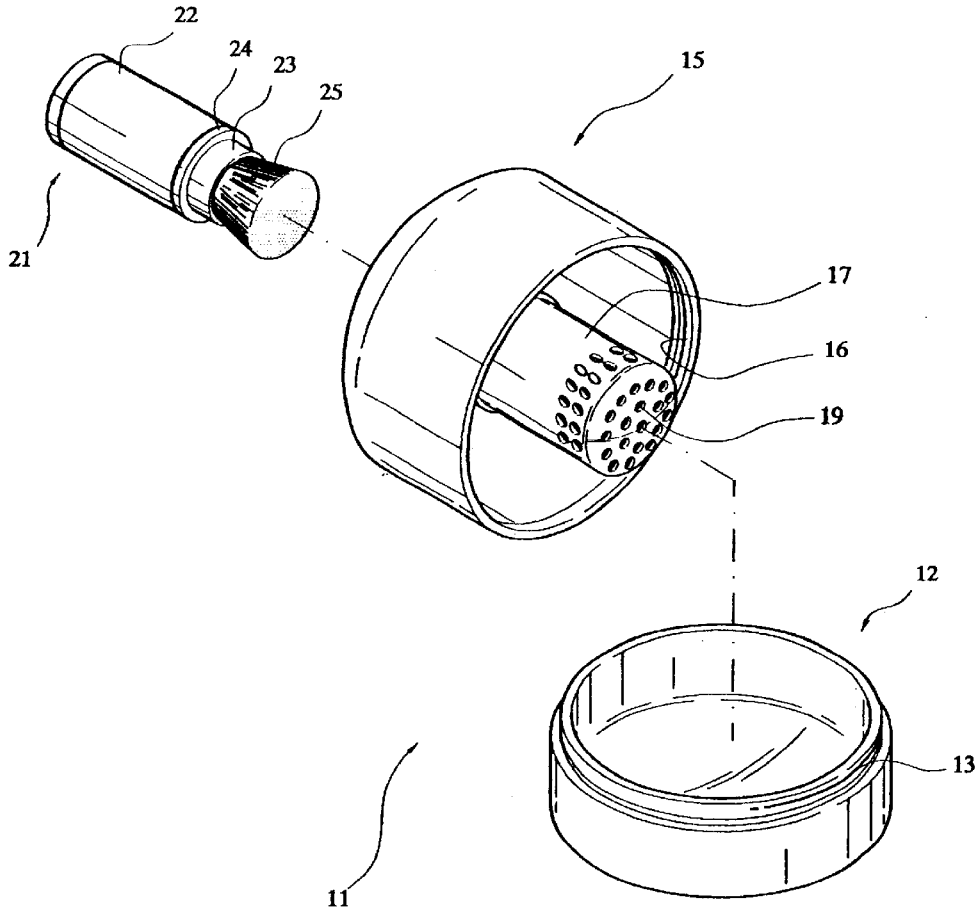
FIG. 2 is a fragmentary perspective of a powder case according to the present utility.

As described in FIG. 2, the powder case 11 according to the present utility includes a lower case 12 and an upper case 15.

The lower case 12 receives the powder 14 in the inner portion of itself and is formed with a male screw 13 as a first conjunction.

The upper case 15 is formed with a female screw 16 as a second conjunction so as to be coupled to the male screw 13 on the inner peripheral surface of the lower case 12. The upper case 15 includes a cylindrical housing 17, which is formed vertically from upper center to the lower. A ledge 18 is formed along middle peripheral of the housing 17 for locking a flange 24 of a brush 21. And, arrays of apertures 19 are formed at the bottom of the housing 17.

The powder case 11 according to the present utility possesses the powder 14 in the lower case 12, and couples the male screw 13 to the female screw 16 on the upper case 15.

Figure 3:
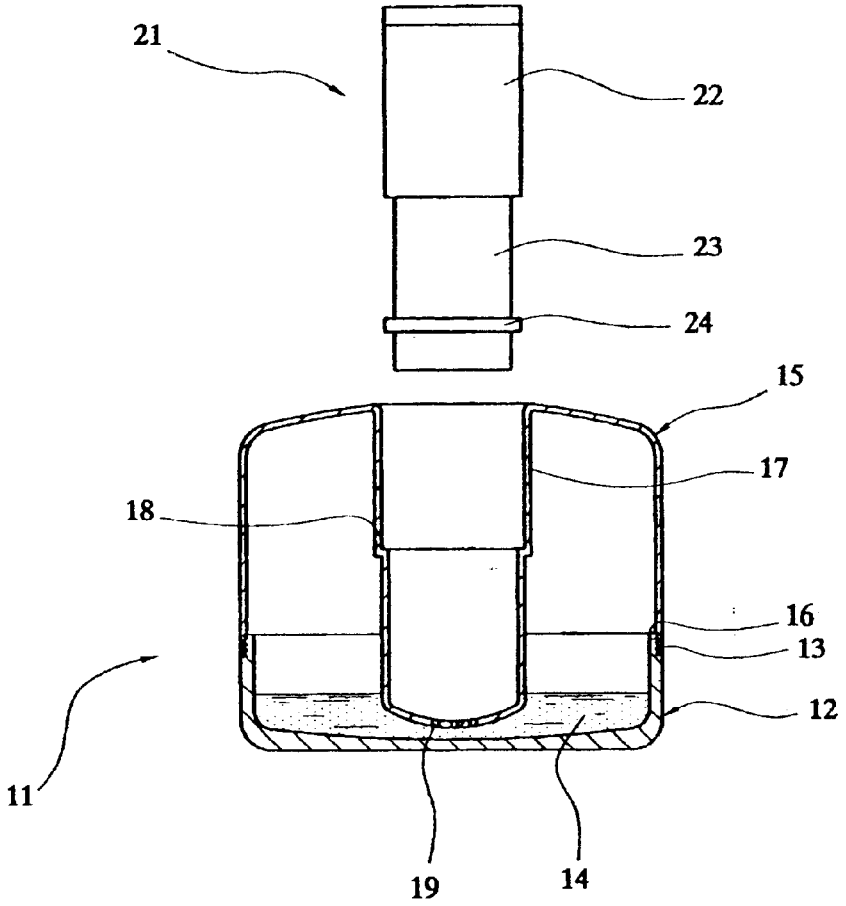
FIG. 3 is a plane of a powder case coupling with a brush according to an embodiment of the present utility.
Figure 4:
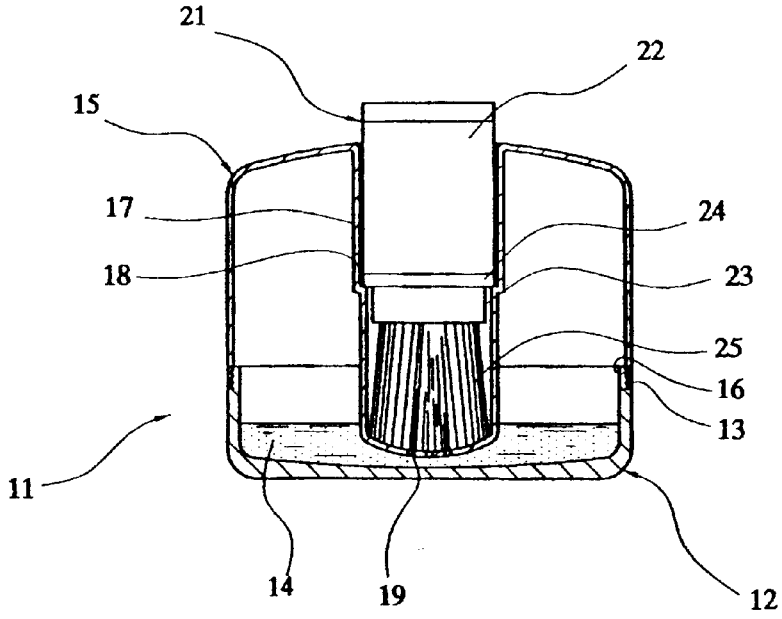
FIG. 4 is a plane of a powder case coupling with a brush according to another embodiment of the present utility.

In order to couple the brush 21 to the housing 17 of the powder case 11, as described in FIG. 3, a slider 23 of the brush 21 should be led out for gathering the brush fur 25 to inside of the slider 23. And then, as described in FIG. 4, the end of the brush 21 is led into the housing 17.

When leading the brush 21 into the housing 17, a flange 24 of the slider 23 is locked by the ledge 18. If pushing the brush 21 continuously, the slider 23 is inserted into the inner case 22, and the brush fur 25 is exposed outwardly, and the powder 14 provided through the apertures 19 of the housing 17 is adhered to the brush fur 25.

The powder case 11 according to present utility is more comfortable than the conventional powder case because the powder 14 is adhered to the brush fur 25 with only a simple work such as pushing the brush 21 into the housing 17.

Besides, when adhering the powder 14 on the brush fur 25, the powder 14 may be dispersed around. In the present utility, all portions of the powder case are closed except only the apertures 19 of the housing 17, and the apertures 19 are intercepted by the brush fur 25. Accordingly, the powder is not dispersed into anywhere except the brush fur 25.

Consequently, the present utility may prevent undesired waste of the powder 14 and the user may use the powder 14 long times while reducing a cost and solve the conventional problem of the uncleanness of the circumference.

Figure 5:
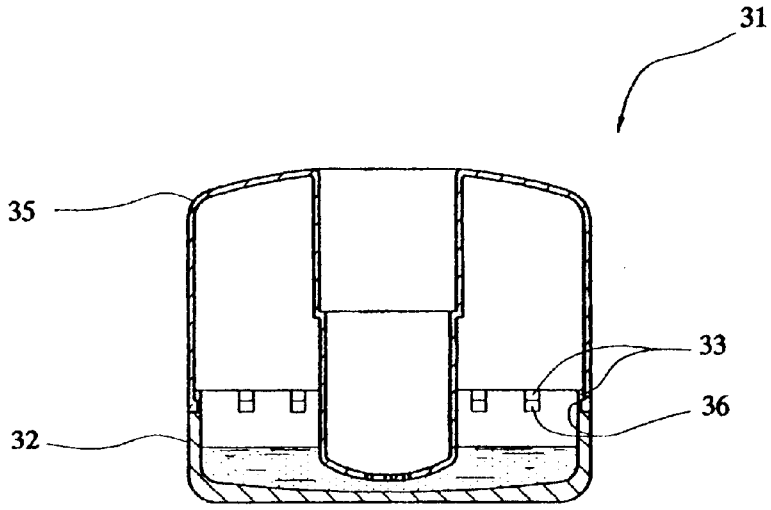
FIG. 5 is an another embodiment of a powder case according to the present utility.

FIG. 5 is another embodiment of a powder case according to the present utility. The powder case 31 includes a plurality of radial supporting protrusions 33 as a first conjunction on upper peripheral of the lower case 32, and also includes a plurality of locking protrusions 36 as a second conjunction around the lower peripheral of the upper case 35.

Consequently, the locking protrusions 36 of the upper case 35 face the supporting protrusions 33 of the lower case 32. If the upper case 35 and the lower case 32 is closed and then the upper case 35 is turned, the locking protrusions 36 of the upper case 35 are located on the bottom of the supporting protrusions 33 of the lower case 32. And then, the upper case 35 and the lower case 32 is locked each other not to be separated.

The powder case 31 is easier to be opened/closed than the powder case 11 including the male screw 13 and the female screw 16 because the powder case 31 is opened/closed by just a little turning of the upper case 35 and the lower case 32.

Figure 6:
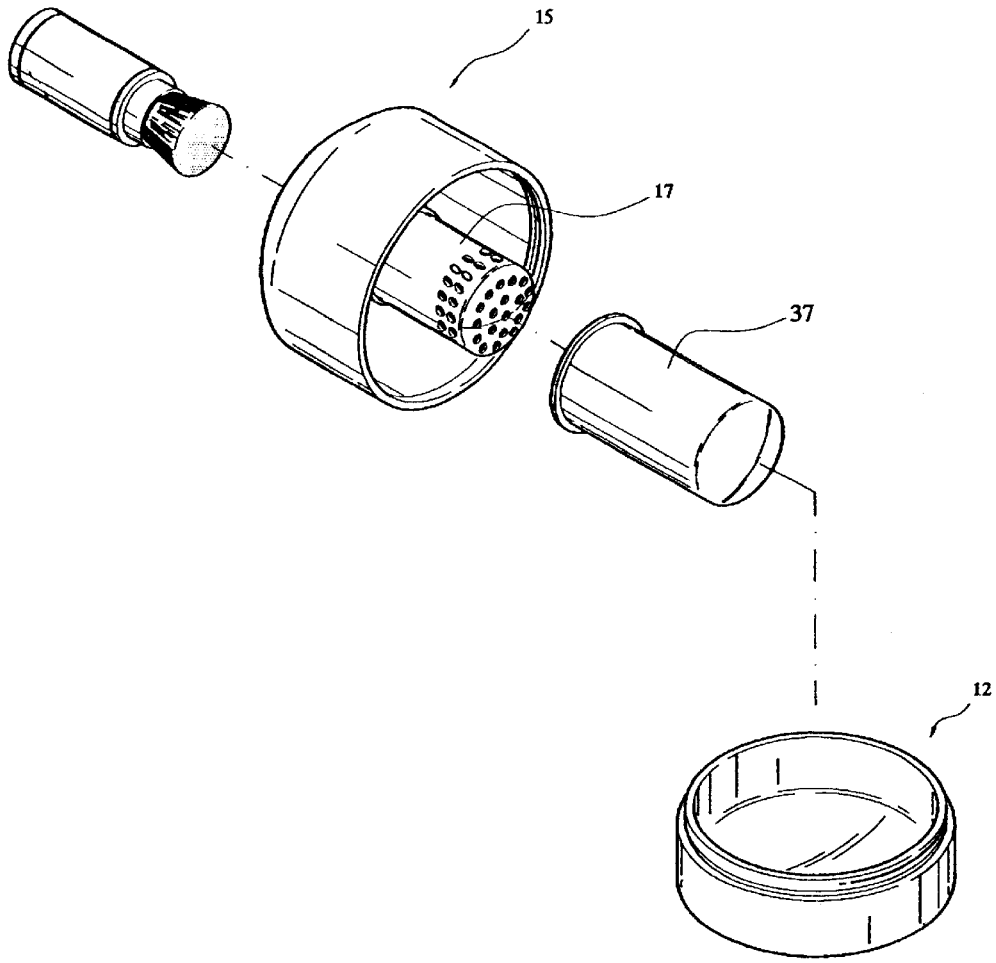
FIG. 6 is a fragmentary perspective of the powder case according to another embodiment of the present utility.

FIG. 6 is a fragmentary perspective of a powder case according to another embodiment of the present utility. The powder case further includes a cover 37 for covering the lower peripheral of the housing 17 included in the upper case 15, 32. The powder case is emerged in condition that the housing 17 is covered by the cover 37. And the powder in the lower case 12 is prevented from being dispersed outwardly through the apertures 19.

Consequently, the present utility has some advantages as follows. If the end of the brush 21 is inserted into the inner of the housing 17 after leading out a slider 23 of the brush 21, the slider 23 is inserted into the case 22 while the flange 24 of the slider 23 is locked on the ledge 18 of the housing 17. Accordingly, the brush fur 25 adheres the powder 14 through the apertures 19. That is, a user may adhere the powder 14 on the brush fur 25 by only inserting the brush 21 into the housing 17. The inserting work is very comfortable, and the loss of the powder is prevented, and the uncleanness of the circumference is solved.

What is claimed is:

1. A powder case comprising a lower case having a chamber for containing a powder and a first connector, an upper case having a second connector complementary to said first connector for mating said upper case and lower case, and an upper surface with an opening at an upper end of a downward extending cylindrical housing, said housing having a lower end with apertures in communication with said chamber, and an inward extending ledge intermediate said upper end and said lower end, and a powder applicator comprising a hollow cylindrical case, a brush mounted in said case and extending downwardly therefrom, and a cylindrical slider telescopically mounted within said case about said brush and having an external shoulder, said slider covering said brush when fully extended from said case, and said shoulder engaging said ledge as said powder applicator is inserted into said cylindrical housing thereby exposing said brush to said lower chamber through said apertures.

2. A powder case as claimed in the claim 1 wherein one of said upper case and said lower case comprises a male screw thread and wherein the other of said upper case and said lower case comprises a female screw thread for engaging said male screw thread to connect said upper case to said lower case.

3. A powder case as claimed in claim 1, wherein the first connector comprises a plurality of radial supporting protrusions formed adjacent the upper circumference of the lower case, and wherein the second connector comprises a plurality of complementary radial locking protrusions formed adjacent the lower circumference of the upper case for interlocking with the supporting protrusions on the lower case.

4. A powder case as claimed in the claim 1, wherein the powder case further includes a cover removably mountable on the housing of the upper case.

* * * * *